United States Patent [19]

Linecker

[11] 4,235,452

[45] Nov. 25, 1980

[54] CROSS-COUNTRY SKI SHOE AND BINDING

[76] Inventor: Josef Linecker, Rosengasse 5, A 5230 Mattighofen, Austria

[21] Appl. No.: 892,770

[22] Filed: Apr. 3, 1978

[30] Foreign Application Priority Data

Apr. 13, 1977 [AT] Austria ..... 2578/77
Feb. 9, 1978 [AT] Austria ..... 924/78

[51] Int. Cl.[3] ..... A63C 9/00; A43B 5/04
[52] U.S. Cl. ..... 280/615; 36/117
[58] Field of Search ..... 280/615, 614, 611, 635, 280/623, 624; 36/117, 116, 115

[56] References Cited

U.S. PATENT DOCUMENTS

| | | | |
|---|---|---|---|
| 3,612,558 | 10/1971 | Kjellstrom | 280/615 |
| 4,106,223 | 8/1978 | Benseler | 280/615 X |
| 4,108,467 | 8/1978 | Kreyenbuhl | 280/615 |

FOREIGN PATENT DOCUMENTS

| | | | |
|---|---|---|---|
| 2610041 | 10/1976 | Fed. Rep. of Germany | 280/615 |
| 215681 | 10/1941 | Switzerland | 280/615 |

*Primary Examiner*—John J. Love
*Assistant Examiner*—Milton L. Smith
*Attorney, Agent, or Firm*—Kurt Kelman

[57] ABSTRACT

A binding for use with a cross-country ski and holding in position a forwardly extending portion of a ski shoe sole, having a front jaw adapted to be affixed to the ski, the front jaw including a stirrup shaped to receive the forwardly extending sole portion which is elastically deformed in an end position of the sole portion received in the stirrup, and the forwardly extending sole portion including an anchoring part engaging the stirrup in the end position. The sole is of synthetic resin and includes upwardly projecting lateral edges forwardly of the heel.

40 Claims, 13 Drawing Figures

CROSS-COUNTRY SKI SHOE AND BINDING

The present invention relates to a binding and a ski shoe for use with a cross-county ski and more particularly to a ski binding, and its combination with the shoe, which comprises a front jaw adapted to be affixed to the ski and to hold in position a forwardly extending portion of the sole of the ski shoe.

Known ski bindings of this type have a front jaw with a plurality of upwardly projecting pins adapted to engage in bores in the shoe sole. The shoe is held in a resilient strap which may be of varied structure. Ski bindings with snap closures are also known. U.S. Pat. No. 4,108,467 discloses a binding for use with a cross-country ski, which comprises a stirrup affixed to the ski and receiving an extension of the ski shoe sole which must be held in position by a pin passing therethrough. The pin may be the shaft of a screw which threadedly engages a cylinder mounted on the stirrup and which may be rotated. It is also possible for the pin to pass through the shoe sole extension transversely and horizontally, in which case it is formed and secured like a safety pin. This type of attachment of the sole extension to the binding is time-consuming and requires many component parts loss of one of which makes the entire binding useless.

In all of the known multi-component bindings, any of the components may wear out individually. Furthermore, engagement and disengagement of the shoe is not without problems and takes time. Also, since the underside of the ski shoe sole is usually ribbed to increase the friction and prevent gliding during a cross-country walk, the hard, ribbed underside of the sole will soon roughen the ski surface. This will cause snow and ice to settle in the crevices, which is highly undesirable.

Conventionally, the soles of ski shoes for use with a cross-country ski are of synthetic resin, and it is desirable to make these synthetic resin soles so that they do not warp. However, if a sole is resistant to flexure so that it does not tend to warp and if it extends in a flat plane, it cannot be used for cross-country skiing because such a stiff sole will rapidly tire the foot of the skier.

Extensive observations have shown that, even if the shoe fits well and is held securely in the binding as well as in the region of the heel, the lateral guidance of the ski is not optimal since lateral displacements of the forward portion of the foot and the uppers surrounding it are possible with respect to the shoe sole. Displacements up to about 10 mm have been observed. This results in an imprecise guidance of the ski, particularly in curves.

It is a primary object of this invention to improve bindings for use with cross-country skis and their combination with associated ski shoes by reducing the component parts of the binding to a minimum and totally avoiding any pivoted or loose parts which may wear out, avoiding various disadvantages of known bindings and providing a binding which may be readily engaged and disengaged without the use of the hands of the skier.

It is another object of the invention to decrease the stiffness of the forwardly extending sole portion and to prevent rotation of the sole portion even when subjected to maximum pressure.

It is also an object of the present invention to improve a shoe for use in cross-country skiing by providing a lateral guidance that remains effective even when the shoe sole is worn.

The above and other objects are accomplished according to one aspect of this invention with a binding for use with a cross-country ski and adapted to hold in position a forwardly extending portion of a ski shoe sole, which comprises a front jaw adapted to be affixed to the ski, the front jaw including a stirrup shaped to receive the forwardly extending sole portion, to deform the forwardly extending sole portion elastically in an end position of the sole portion in the stirrup, and to anchor the forwardly extending sole portion to the binding in the end position.

According to another aspect of the invention, there is provided a combination of a binding for use with a cross-country ski and a ski shoe having an elastically deformable, forwardly extending sole portion adapted to be held in position by the binding. The binding comprises a front jaw adapted to be affixed to the ski, the front jaw including a stirrup shaped to receive the forwardly extending sole portion, the forwardly extending sole portion being elastically deformed in an end position of the sole portion received in the stirrup, and the forwardly extending sole portion including an anchoring part engaging the stirrup in the end position.

In accordance with yet another aspect of the present invention, there is provided a ski shoe for use with a cross-country ski and comprising a sole having an elastically deformable, forwardly extending sole portion including an anchoring part adapted to be deformed elastically and held in an end position in a stirrup of a binding affixed to the ski.

The above and other objects, advantages and features of the invention will become more apparent from the following detailed description of certain now preferred embodiments thereof, taken in conjunction with the accompanying schematic drawing wherein FIG. 1 is a side view, partly in section, of one embodiment of a binding and ski shoe according to the present invention;

Figure 11:
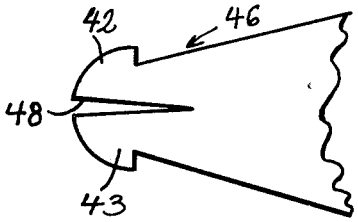
Figure 12:
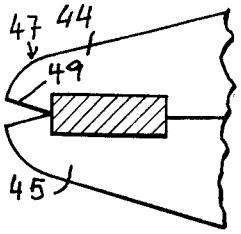
Figure 13:
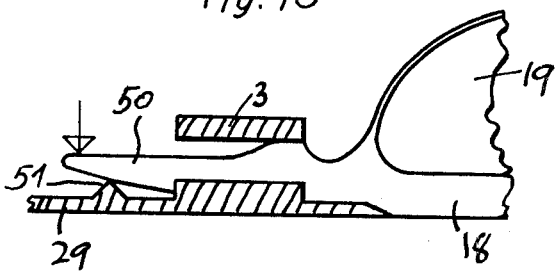

FIGS. 8 to 12 schematically show top views of the forwardly extending sole portion incorporating various optional features; and FIG. 13 is a partial side elevational view, partly in section, of yet another embodiment.

Throughout the drawing, like reference numerals designate like parts functioning in a like manner.

Figure 1:
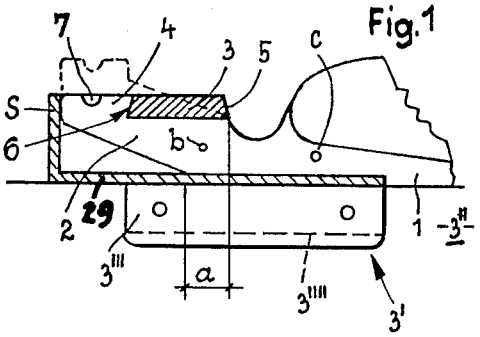
Figure 2:
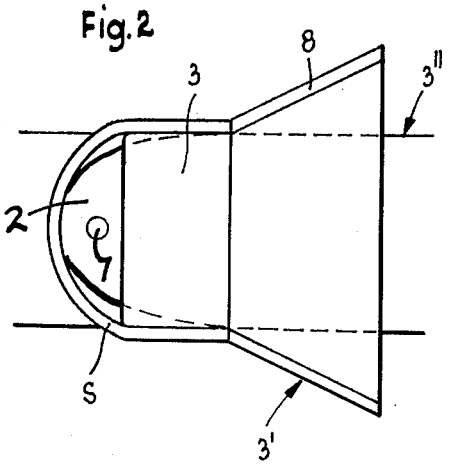
FIG. 2 is a top view of FIG. 1.

Referring now to the drawing and first to FIGS. 1 and 2, there is shown the forward part of sole 1 of a ski boot, this forward part being tapered not to exceed the width of a cross-country ski and having a further tapered forwardly extending portion 2. The binding for use with this cross-country ski and adapted to hold the forwardly extending sole portion in position comprises front jaw 3' adapted to be affixed to the ski, for instance by an adhesive and/or fastening elements, such as screws or bolts, the illustrated front jaw of the binding including depending side plates 3''' which are screwed to the lateral edges 3'' of the ski. The front jaw of the binding includes stirrup 3 which is a strap shaped to receive forwardly extending sole portion 2 and to deform this portion elastically in the illustrated end position of sole portion 2 in stirrup 3. As shown in broken lines in FIG. 1, in its untensioned condition, forwardly extending sole portion 2 rises substantially above the level of the stirrup but when inserted thereinto to subtend the stirrup, it is depressed so that it is yieldingly and firmly held in stirrup 3 of the binding and is anchored thereto in the illustrated end position, the tensioning of sole portion 2 by stirrup 3 assuring a firm grip thereon in the binding. The forward anchoring part of sole portion 2 yieldingly engages stirrup 3 and has recessed abutment 4 which forms a hook engaging forward edge 6 of stirrup 3.

Front jaw 3' of the binding comprises base plate 29 supporting stirrup 3 and protective edge S projecting upwardly from the base plate frontward of the stirrup, the upwardly projecting protective edge conforming generally to the shape of the front part of forwardly extending sole portion 2, as best shown in FIG. 2. The stirrup is arranged between the shoe and the anchoring part of sole portion 2 engaging the stirrup. Forward edge 6 of the stirrup faces, but is spaced from, protective edge S. Undercut abutment 4 of the anchoring part conforms to inclined forward edge 6 of the transversely extending strap constituting stirrup 3.

The forwardly extending sole portion rises from the sole of the ski boot at an obtuse angle along a transverse line extending between the forward edge 6 and the rear edge 5 of stirrup strap 3, this line being spaced a distance a from rear edge 5, i.e. being closer thereto than to the forward edge of the stirrup. In this manner, a more or less parallel guide for forwardly extending sole portion 2 through the opening defined between base plate 29 and stirrup 3 is assured. Since pivot b constituted by the transverse line whence sole portion 2 rises at an obtuse angle is offset from rear edge 5 of stirrup 3, the rearwardly inclined front edge 6 of the stirrup will be firmly anchored in the undercut abutment of anchoring part 4. In a cross-country ski boot, pivot c about which forwardly extending sole portion 2 may be bent in relation to sole 1 is spaced rearwardly from binding stirrup 3 so that raising of the heel during cross-country skiing will not cause sole portion 2 to be flexed within the binding.

The above-described combination has the advantage that, with the heel raised, forwardly extending sole portion 2 may be simply inserted into the binding until, in the end position, the undercut abutment in its anchoring part 4 will snap into engagement with inclined forward edge 6 of stirrup 3, thus fixing the boot in position on the ski. Distance a will be selected in accordance with the elasticity of the sole material to make certain that no flexing forces will be transmitted to forwardly extending sole portion 2 when the heel is raised during cross-country skiing. With anchoring part 4 at a substantially higher level in its untensioned condition than the stirrup of the binding so that it is yieldingly depressed thereby when it subtends the stirrup strap and with the hooking engagement of the anchoring part and the stirrup strap in the end position, tensioning forces will always be transmitted upwardly to the stirrup strap even when the heel is raised to its highest position. Protective edge S prevents snow from lodging below forwardly extending sole portion 2, which may form an ice wedge under anchoring part 4 and make disengagement from the binding difficult. The protective edge, as shown in FIG. 1, is preferably extended to the upper edge of sole portion 2, thus assisting in the prevention of an accidental disengagement of the ski boot from the binding.

To enable the boot to be readily disengaged without the use of the skier's hands and bending down, the tip of anchoring part 4 of forwardly extending sole portion 2 defines a round notch 7 adapted to receive a point of a ski pole whereby the sole portion may be engaged and depressed by the ski pole for disengaging the ski boot from the binding. Upon depressing the anchoring part below the level of stirrup strap 3, the sole portion 2 may simply be slipped out of the binding.

Affixing the front jaw of the binding to lateral edges 3'' of the ski by means of side plates has the advantage that the rigidity of the ski is not reduced by tap holes for screws affixing the base plate to the ski surface. However, any suitable attachment, including a combination of adhesive and mechanical fastening, may be used. Also, as shown in FIG. 1, side plates 3''' may have webs 3'''' wedging into lateral edges 3'' of the ski for a firmer grip.

As is shown in FIG. 2, front jaw 3' of the binding may comprise conical guide piece 8 for facilitating the guidance and insertion of forwardly extending sole portion 2 into the binding and also improving the lateral guidance of the ski. As shown in broken lines, the lateral walls of stirrup 3 also may conically converge to improve the seating of sole portion 2 in the stirrup.

Figure 3:
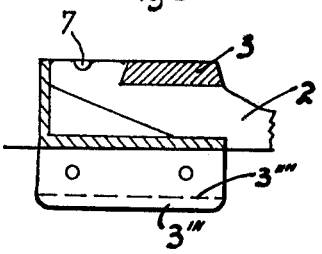
FIGS. 3 and 4 are views similar to FIG. 1 and showing two further embodiments.

The modification illustrated in FIG. 3 differs from that of FIGS. 1 and 2 by the fact that it omits guide piece 8, thus shortening the binding.

Figure 4:
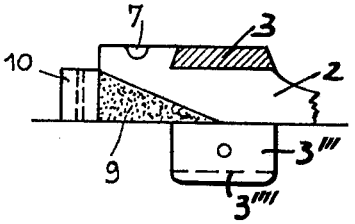

In the embodiment of FIG. 4, the binding has no base plate and stirrup 3 is mounted directly on the ski by side plates 3'''. In this embodiment, lodging of snow or ice between the ski surface and the rising anchoring part of forwardly extending sole portion 2 in front of the stirrup is prevented by wedge 9 of an elastic foam material, which is affixed to the ski frontward or stirrup 3 and is adapted to hold the forwardly extending sole portion in the end position against forward movement. The wedge is held in position by a pivotal or slidable member 10 affixed to the ski.

Figure 5:
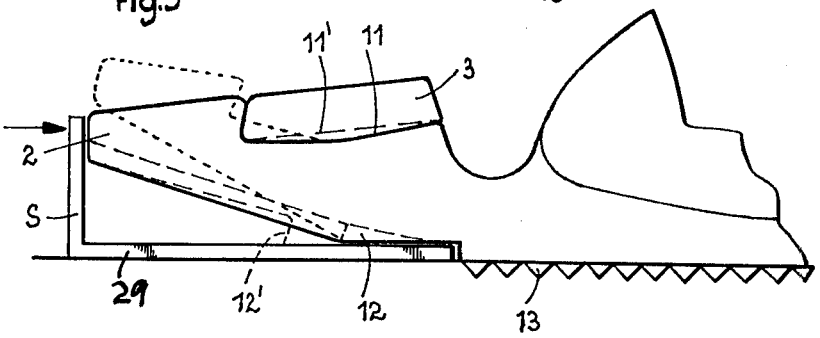
FIG. 5 is a side elevational view, on an enlarged scale, showing various optional and preferred details of the sole and the forwardly extending sole portion, as well as of the stirrup.

The enlarged showing of FIG. 5 indicates configurations of stirrup 3 and forwardly extending sole portion 2 which assure optimal anchoring of these two parts to each other. Thus, as shown at 11, the underside of stirrup strap 3 may be partially inclined with respect to the plane of the surface of the ski, i.e. it may rise in relation thereto in the direction of the ski boot, or, as shown in broken lines at 11', the entire underside of the stirrup strap may be so inclined. Furthermore, inclined plane means constituted by wedges 12 extending over part of the width of base plate 29 are provided to project from the base plate into the opening defined between the base plate and the stirrup, this inclined plane means being adapted to engage corresponding groove means in the underside of forwardly extending sole portion 2.

Depending on the rigidity or elasticity of the material forming forwardly extending sole portion 2 and as shown in broken lines in FIG. 5, transverse ledge 12' may be provided on the underside of this sole portion and the sole portion may have a reduced transverse cross section forwardly of the ledge. In this manner, the force required for insertion of sole portion 2 in the binding and its flexing capacity may be adjusted within desired limits. The untensioned condition of sole portion 2, when it does not subtend stirrup strap 3, is also indicated in this figure, as in FIG. 1. In the untensioned or rest position, the forwardly extending sole portion must rise to a level sufficiently high above that of the stirrup that, when this sole portion is depressed and restrained by the stirrup, the upward pressure of sole portion 2 against the underside of stirrup 3, which it subtends, always assures a firm anchoring of the ski boot in the front jaw of the binding, even when the heel is raised to its highest level during cross-country skiing.

Figure 6:
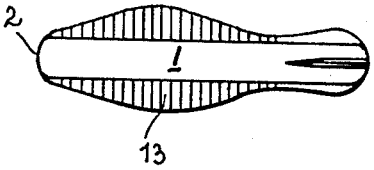
FIG. 6 is a bottom plan view of the shoe of FIG. 5.

As shown in FIGS. 5 and 6, forwardly extending sole portion 2 and sole 1 has laterally extending parts 13 having a ribbed or corrugated underside and leaving therebetween a longitudinally extending sole part for engagement with the surface of the ski. The ribbed parts of the sole will prevent sliding and this modification is particularly useful with the embodiments of FIGS. 3 and 4.

Figure 7:
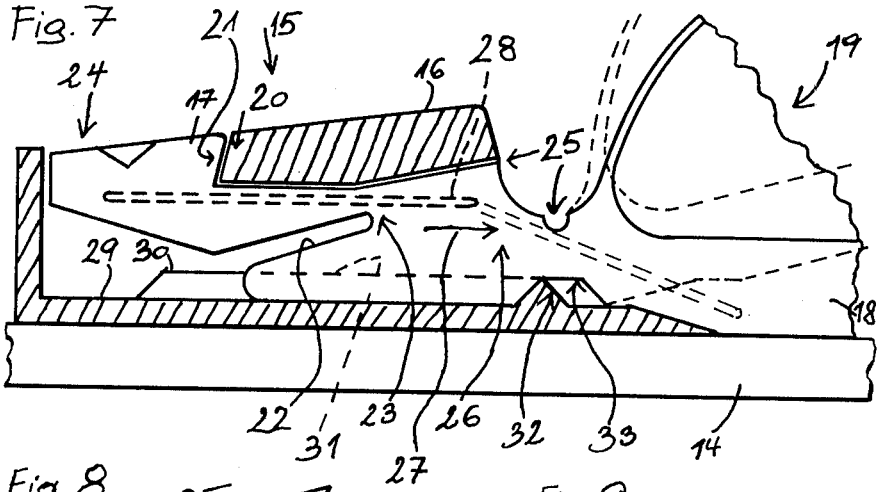
FIG. 7 is a view similar to that of FIG. 1, on an enlarged scale, of another embodiment.

In the embodiment of FIG. 7, the binding is substantially of the form shown in FIG. 5, including front jaw 15 comprising base plate 29 supporting stirrup strap 16 which has forward edge 20, the base plate being affixed to ski 14 and defining an opening with strap 16 for receiving forwardly extending portion 26 of sole 18 of ski boot 19. Sole portion 26 has anchoring part 17 whose recessed abutment 21 is engaged by forward edge 20 of the stirrup in the illustrated end position.

Forwardly extending sole portion 26 defines transverse slot 22 extending upwardly from the underside of the sole portion and rearwardly from anchoring part 17 thereof. This oblique slot in sole portion 26 is so wide and leaves at its upper and inner end 23 such a thin layer of sole material that a pivot is defined thereat for pivoting anchoring part 17 in relation to the rear part of sole portion 26. The sole portion itself is pivotal in relation to sole 18 about pivot 25 rearwardly of stirrup 16.

Figure 8:
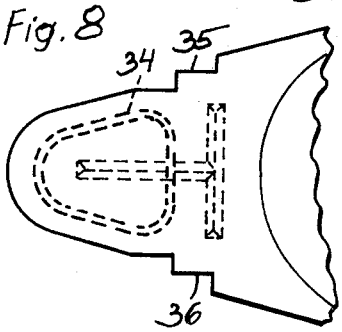

To avoid extension of anchoring part 17 when subjected to a tensile force in the direction of arrow 17, steel leaf spring 28 is embedded in sole portion 26 and extends throughout its length. As shown in FIG. 8, such inserts may take the form of a loop 34 and other shapes of inserts, such as bands or grids may be used to the same effect. Also, instead of steel inserts, it is possible to use another hard material of less extensibility than the sole material, and if the sole is an injection-molded synthetic resin, it may simply be injection molded about such inserts. The inserts may have a gage of about 1 mm, for example.

If desired, forward edge 20 and conforming abutment 21 may be arcuate so that the corners of anchoring part 17 will be sufficiently depressed when a ski pole engages notch 7 and is pressed down to assure disengagement of the anchoring part from the stirrup strap and enable the ski boot to be slipped out of the binding. Such an arcuate formation will also improve the hooking engagement between stirrup and anchoring part as the ski is moved in various directions.

In the embodiment of FIG. 7, base plate 29 of the front jaw has webs 30 extending in the longitudinal direction of ski 14 and the underside of forwardly extending sole portion 26 defines corresponding grooves 31 receiving the webs. This improves the guidance of the ski boot in relation to the binding and also holds the boot therein against lateral movement. One such web and meshing groove along the longitudinal center line of the ski or a plurality of such webs and grooves may be provided.

As shown in the drawing, lengthwise slipping of the ski boot in the binding may be further prevented by providing transverse webs 32 on the base plate to cooperate with shoulder or groove 33 in the sole portion 26. These webs and grooves need not extend over the entire width of the binding and sole, and are so dimensioned that they do not interfere with the engagement and disengagement of the ski boot, being designed to absorb horizontal forces and thus relieving tension on anchoring part 17. At the same time, groove 33 provides an advantageous flexing line in cooperation with notched pivot 25, which facilitates cross-country skiing. Generally, these transverse webs and grooves do not extend to the lateral edges of the base plate and sole portion 26 so as not to reduce the horizontal stiffness. Groove 33 is preferably wider than web 32 so that tensile forces and resulting extensions of the sole are distributed over a larger width.

As indicated in broken lines, the ski boot is manufactured with forwardly extending sole portion 26 enclosing an angle with sole 18 of the boot so as to reduce any extension of sole portion 26 when it is bent down into the binding and held therein.

In the embodiment of FIG. 8, the forwardly extending sole portion has a pair of lateral guide faces 35, 36 extending substantially parallel to each other in the longitudinal direction of the ski for engaging contact with corresponding extending guide faces of the stirrup. As indicated hereinabove, the forwardly extending sole portion tends to be extended by tensile forces transmitted thereto during skiing. If the later engaging faces of the binding stirrup are strongly conical, i.e. converge, this leads to looseness impairing the safety of the binding. Parallel guide faces of a length exceeding any possible extension of the forwardly extending sole portion during skiing will assure proper guidance for the boot in the binding.

Figure 9:
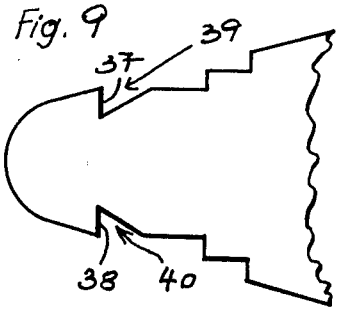

The anchoring part 17 is subjected to flexing at the points of hooking engagement with the stirrup. This is avoided by providing, as shown in FIG. 9, lateral hooking recesses 37, 38 which retain the vertical hooking movement between anchoring part 17 and stirrup 16, forces 39, 40 exerted upon the hooking points pressing against each other.

Figure 10:
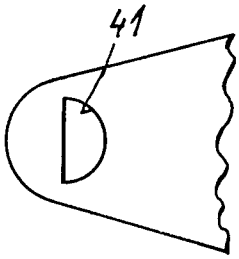

A similarly functioning anchoring of the forwardly extending sole portion to the ski binding is obtained in the embodiment of FIG. 10 by providing a cut-out 41 in this sole portion forwardly of the stirrup in the anchoring part of the sole portion and engaging this cut-out with a corresponding projection in the front jaw of the binding.

In the embodiment of FIG. 11, the forwardly extending sole portion 46 has a pair of laterally recessed engaging faces for hooked engagement with corresponding abutments in the front jaw, which abutments constitute the binding stirrup in this embodiment. In this embodiment, the anchoring part of the forwardly extending sole portion defines vertical slot 48 of V-shaped cross section extending between the laterally recessed engaging faces whereby the anchoring part is divided into two sections 42 and 43 horizontally displaceable towards each other. In this manner, the forwardly extending sole portion may be elastically deformed when it is received between the lateral abutments provided by the stirrup of the binding and anchoring part sections 42, 43 are elastically pressed horizontally outwardly against the stirrup abutments to anchor the forwardly extending sole portion to the binding in the end position.

In the modification of FIG. 12, forwardly extending sole portion 47 defines slot 49 of V-shaped cross section dividing the anchoring part in two sections 44 and 45 similar in structure and function to the embodiment of FIG. 11, the facing walls of the two sections defining therebetween a cut-out for engagement with a corresponding projection of the front jaw of the binding. Thus, the forwardly extending sole portion may be anchored to the binding by lateral hooking.

In the embodiment of FIG. 13, forwardly extending sole portion 50 has a transversely recessed groove in its underside, which is anchored to a transverse ledge of base plate 29 when sole portion 50 is in its end position and is elastically deformed by stirrup strap 3 to press the recessed groove into engagement with the ledge, thus hooking sole portion 50 to the binding and anchoring it therein. A pivot 51 is mounted on the base plate forwardly of the ledge so that the anchoring part of sole portion 50 may be flexed thereabout for unhooking the sole portion and enabling the ski boot to be disengaged from the binding.

While the forwardly extending sole portion has been described and illustrated as an integral portion of the boot sole and being of the same material, this need not be so, and such a forwardly extending portion may, in fact, be attached to an existing sole in any suitable manner and may be comprised of any suitable material, including metal.

What is claimed is:

1. A binding for use with a cross-country ski and adapted to hold in position an elastically deformable, forwardly extending portion of a ski shoe sole, the sole and the sole portion extending in the same direction, which comprises a front jaw adapted to be affixed to the ski, the front jaw including a stirrup shaped to receive the forwardly extending sole portion and to deform the forwardly extending sole portion elastically in an end position of the sole portion for snapping engagement with the stirrup, thereby to anchor the forwardly extending sole portion to the binding in the end position by elastic engagement of the sole portion with the stirrup.

2. A binding for use with a cross-country ski and adapted to hold in position an elastically deformable, forwardly extending portion of a ski shoe sole, which comprises a front jaw adapted to be affixed to the ski, the front jaw including a stirrup shaped to receive the forwardly extending sole portion and to deform the forwardly extending sole portion elastically in an end position of the sole portion for snapping engagement with the stirrup, thereby to anchor the forwardly extending sole portion to the binding in the end position by elastic engagement of the sole portion with the stirrup, a base plate supporting the stirrup and a protective edge projecting upwardly from the base plate frontward of the stirrup, the upwardly projecting protective edge conforming generally to the shape of a front part of the forwardly extending sole portion.

3. The ski binding of claim 2, wherein the stirrup has an inclined forward edge facing, but spaced from, the upwardly projecting protective edge, the forwardly extending sole portion being capable of snappingly engaging the forward edge.

4. A binding for use with a cross-country ski and adapted to hold in position an elastically deformable, forwardly extending portion of a ski shoe sole, which comprises a front jaw adapted to be affixed to the ski, the front jaw including a stirrup shaped to receive the forwardly extending sole portion and to deform the forwardly extending pole portion elastically in an end position of the sole portion for snapping engagement with the stirrup, thereby to anchor the forwardly extending sole portion to the binding in the end position by elastic engagement of the sole portion with the stirrup, and a wedge of an elastic foam material affixed to the ski frontward of the stirrup and adapted to hold the forwardly extending sole portion in the end position against forward movement.

5. A binding for use with a cross-country ski and adapted to hold in position an elastically deformable, forwardly extending portion of a ski shoe sole, which comprises a front jaw adapted to be affixed to the ski, the front jaw including a stirrup shaped to receive the forwardly extending sole portion and to deform the forwardly extending sole portion elastically in an end position of the sole portion for snapping engagement with the stirrup, thereby to anchor the forwardly extending sole portion to the binding in the end position by elastic engagement of the sole portion with the stirrup, a base plate supporting the stirrup, the base plate and the stirrup defining an opening therebetween for receiving the forwardly extending sole portion, and transversely extending inclined plane means projecting from the base plate into the opening, the inclined plane means being adapted to engage corresponding groove means in the underside of the forwardly extending sole portion.

6. In combination, a binding for use with a cross-country ski and a ski shoe having a sole and an elastically deformable, forwardly extending sole portion adapted to be held in position by the binding, the sole and the sole portion extending in the same direction, the binding comprising a front jaw adapted to be affixed to the ski, the front jaw including a stirrup shaped to receive the forwardly extending sole portion, the forwardly extending sole portion being elastically deformed in an end position of the sole portion received in the stirrup for snapping engagement with the stirrup, and the forwardly extending sole portion including an anchoring part snappingly engaging the stirrup in the end position for substantially immovably holding the sole portion in position in the binding.

7. The combination of claim 6, wherein the stirrup is arranged between the shoe and the anchoring part engaging the stirrup.

8. The combination of claim 7, wherein the anchoring part yieldingly engages the stirrup.

9. The combination of claim 6, further comprising a transverse ledge on the underside of the forwardly extending sole portion, the sole portion having a reduced transverse cross section forwardly of the ledge.

10. In combination, a binding for use with a cross-country ski and a ski shoe having a sole and an elastically deformable, forwardly extending sole portion adapted to be held in position by the binding, the sole and the sole portion extending in the same direction and the sole portion including an anchoring part enclosing an obtuse angle with the ski shoe sole, the binding comprising a front jaw including a stirrup shaped to receive the forwardly extending sole portion and arranged between the shoe and the anchoring part, the stirrup including a transversely extending strap having a forward and a rear edge, the forwardly extending sole portion being elastically deformed in an end position of the sole portion received in the stirrup for snapping engagement with the stirrup and the anchoring part having a recessed abutment yieldingly and snappingly engaging the forward edge of the strap for substantially immovably holding the sole portion in position in the binding.

11. The combination of claim 10, wherein the abutment is undercut and the forward edge of the strap is inclined to conform to the undercut abutment.

12. The combination of claim 10, wherein the forwardly extending sole portion rises from the ski shoe sole at the obtuse angle along a transverse line extending between the forward and rear edges of the strap, the forwardly extending sole portion extending substantially above the level of the strap when not engaged thereby and being elastically deformed along the transverse line by the strap snappingly engaging the forwardly extending sole portion.

13. The combination of claim 12, wherein the transverse line is closer to the rear edge than to the forward edge of the strap and constitutes a pivot about which the forwardly extending sole portion is pivotal in relation to the ski shoe sole.

14. In combination, a binding for use with a cross-country ski and a ski shoe having a sole and an elastically deformable, forwardly extending sole portion adapted to be held in position by the binding, the sole and the sole portion extending in the same direction and the sole portion including an anchoring part, the binding comprising a front jaw including a stirrup shaped to receive the forwardly extending sole portion, the forwardly extending sole portion being elastically deformed in an end position of the sole portion received in the stirrup for snapping engagement with the stirrup and the anchoring part snappingly engaging the stirrup in the end position for substantially immovably holding the sole portion in position in the binding, and the front jaw further including a base plate supporting the stirrup and a protective edge projecting upwardly from the base plate frontward of the stirrup, the upwardly projecting protective edge conforming generally to the shape of the anchoring part of the forwardly extending sole portion.

15. The combination of claim 14, wherein the stirrup has an inclined forward edge facing, but spaced from, the upwardly projecting protective edge.

16. In combination, a binding for use with a cross-country ski and a ski shoe having a sole and an elastically deformable, forwardly extending sole portion adapted to be held in position by the binding, the sole and the sole portion extending in the same direction and the sole portion including an anchoring part, the binding comprising a front jaw including a stirrup shaped to receive the forwardly extending sole portion, the forwardly extending sole portion being elastically deformed in an end position of the sole portion received in the stirrup for snapping engagement with the stirrup and the anchoring part snappingly engaging the stirrup in the end position for substantially immovably holding the sole portion in position in the binding, and further comprising a wedge of an elastic foam material affixed to the ski frontwardly of the stirrup and holding the forwardly extending sole portion in the end position against forward movement.

17. In combination, a binding for use with a cross-country ski and a ski shoe having a sole and an elastically deformable, forwardly extending sole portion adapted to be held in position by the binding, the sole and the sole portion extending in the same direction and the sole portion including an anchoring part, the binding comprising a front jaw including a stirrup shaped to receive the forwardly extending sole portion, the forwardly extending sole portion being elastically deformed in an end position of the sole portion received in the stirrup for snapping engagement with the stirrup and the anchoring part snappingly engaging the stirrup in the end position for substantially immovably holding the sole portion in position in the binding, and the anchoring part defining a notch adapted to receive a point of a ski pole whereby the sole portion may be engaged and depressed by the ski pole for disengaging the ski shoe from the binding.

18. In combination, a binding for use with a cross-country ski and a ski shoe having a sole and an elastically deformable, forwardly extending sole portion adapted to be held in position by the binding, the sole and the sole portion extending in the same direction and the sole portion including an anchoring part, the binding comprising a front jaw including a stirrup shaped to receive the forwardly extending sole portion, the forwardly extending sole portion being elastically deformed in an end position of the sole portion received in the stirrup for snapping engagement with the stirrup and the anchoring part snappingly engaging the stirrup in the end position for substantially immovably holding the sole portion in position in the binding, and the front jaw further including a base plate supporting the stirrup, the base plate and the stirrup defining an opening therebetween for receiving the forwardly extending sole portion, and further comprising transversely extending inclined plane means projecting from the base plate into the opening, the inclined plane means engaging corresponding groove means in the underside of the forwardly extending sole portion.

19. In combination, a binding for use with a cross-country ski and a ski shoe having a sole and an elastically deformable, forwardly extending sole portion adapted to be held in position by the binding, the sole and the sole portion extending in the same direction, the binding comprising a front jaw including a stirrup shaped to receive the forwardly extending sole portion, the forwardly extending sole portion being elastically deformed in an end position of the sole portion received in the stirrup for snapping engagement with the stirrup, the forwardly extending sole portion including an anchoring part snappingly engaging the stirrup in the end position for substantially immovably holding the sole portion in position in the binding and the forwardly extending sole portion defining a transverse slot extending upwardly from the underside of the sole portion and rearwardly from the anchoring part thereof.

20. The combination of claim 19, further comprising a steel leaf spring insert extending longitudinally through the forwardly extending sole portion.

21. The combination of claim 19, wherein the forwardly extending sole portion has a pair of lateral guide faces extending substantially parallel to each other in the longitudinal direction of the ski, and the stirrup has correspondingly extending guide faces in contact with the lateral guide faces of the sole portion.

22. The combination of claim 19, wherein the front jaw has webs extending in the longitudinal direction of the ski and the underside of the forwardly extending sole portion defines corresponding grooves receiving the webs.

23. The combination of claim 19, wherein the forwardly extending sole portion defines a cut-out forwardly of the stirrup in the anchoring part, and the front jaw has a corresponding projection engaging the cut-out.

24. The combination of claim 19, wherein the forwardly extending sole portion has a pair of laterally recessed engaging faces adjacent the anchoring part, the stirrup being in hooked engagement with the recesses for holding the sole portion substantially immovable in said direction.

25. The combination of claim 24, wherein the anchoring part of the forwardly extending sole portion defines a slot of V-shaped cross section extending into the forwardly extending sole portion between the laterally recessed engaging faces to form two sections yieldingly displaceable in a lateral direction for snapping engagement of the sections with the stirrup at the engaging faces.

26. In combination, a binding for use with a cross-country ski and a ski shoe having a sole and an elastically deformable, forwardly extending sole portion adapted to be held in position by the binding, the sole and the sole portion extending in the same direction, the binding comprising a front jaw including a stirrup shaped to receive the forwardly extending sole portion, the forwardly extending sole portion being elastically deformed in an end position of the sole portion received in the stirrup for snapping engagement with the stirrup, the forwardly extending sole portion including an anchoring part snappingly engaging the stirrup in the end position for substantially immovably holding the sole portion in position in the binding, the anchoring part of the forwardly extending sole portion defining a slot of V-shaped cross section dividing the anchoring part into two sections yieldingly displaceable in a lateral direction for elastic lateral engagement with the stirrup, facing walls of the two sections defining therebetween a cut-out, and the front jaw having a projection corresponding to the cut-out and engaging the same.

27. A ski shoe for use with a cross-country ski and comprising a sole having an elastically deformable, forwardly extending sole portion including an anchoring part, the sole portion being adapted to be elastically deformed in an end position by a stirrup of a binding affixed to the ski and the anchoring part being in snapping engagement with the stirrup in the end position.

28. The ski shoe of claim 27, wherein the forwardly extending sole portion encloses an obtuse angle with the sole and the anchoring part has a recessed abutment for engagement with a forward edge of a transversely extending strap forming the stirrup.

29. The ski shoe of claim 28, wherein the abutment is undercut.

30. The ski shoe of claim 28, wherein the forwardly extending sole portion rises from the ski shoe sole at the obtuse angle along a transverse line, the forwardly extending sole portion extending substantially above the level of the stirrup strap when not engaged thereby.

31. The ski shoe of claim 30, wherein the transverse line constitutes a pivot about which the forwardly extending sole portion is pivotal in relation to the ski shoe sole.

32. The ski shoe of claim 27, wherein the anchoring part of the forwardly extending sole portion defines a notch adapted to receive a point of a ski pole whereby the sole portion may be engaged and depressed by the ski pole for disengaging the ski shoe from the binding.

33. The ski shoe of claim 27, further comprising a transverse ledge on the underside of the forwardly extending sole portion, the sole portion having a reduced transverse cross section forwardly of the ledge.

34. The ski shoe of claim 27, wherein the forwardly extending sole portion defines a transverse slot extending upwardly from the underside of the sole portion and rearwardly from the anchoring part thereof.

35. The ski shoe of claim 34, further comprising a steel leaf spring insert extending longitudinally through the forwardly extending sole portion.

36. The ski shoe of claim 34, wherein the forwardly extending sole portion has a pair of lateral guide faces extending substantially parallel to each other in the longitudinal direction of the ski for contacting engagement with correspondingly extending guide faces of the stirrup.

37. The ski shoe of claim 34, wherein the forwardly extending sole portion defines a cut-out in the anchoring part for engagement with a corresponding projection in the binding.

38. The ski shoe of claim 34, wherein the forwardly extending sole portion has a pair of laterally recessed engaging faces adjacent the anchoring part, the stirrup being in hooked engagement with the recesses for holding the sole portion substantially immovable in said direction.

39. The ski shoe of claim 38, wherein the anchoring part of the forwardly extending sole portion defines a slot of V-shaped cross section extending into the forwardly extending sole portion between the laterally recessed engaging faces to form two sections yieldingly displaceable in a lateral direction for snapping engagement of the sections with the stirrup at the engaging faces.

40. The ski shoe of claim 27, the anchoring part of the forwardly extending sole portion defining a slot of V-shaped cross section dividing the anchoring part into two sections yieldingly displaceable in a lateral direction for elastic lateral engagement with the stirrup, facing walls of the two sections defining therebetween a cut-out, and the front jaw having a projection corresponding to the cut-out and engaging the same.

* * * * *